US006668471B1

(12) United States Patent
Cook et al.

(10) Patent No.: US 6,668,471 B1
(45) Date of Patent: Dec. 30, 2003

(54) TOWABLE EARTH DIGGING APPARATUS

(75) Inventors: Paul Cook, Oconomowoc, WI (US); Karl Schulz, Brookfield, WI (US)

(73) Assignee: Excavation Technology Corporation, Oconomowoc, WI (US)

( * ) Notice: Subject to any disclaimer, the term of this patent is extended or adjusted under 35 U.S.C. 154(b) by 65 days.

(21) Appl. No.: 09/654,356

(22) Filed: Sep. 1, 2000

(51) Int. Cl.[7] ..... E02E 3/96
(52) U.S. Cl. ..... 37/410; 414/685
(58) Field of Search ..... 37/241, 403, 407, 37/405, 406, 410; 414/685, 690, 694

(56) References Cited

U.S. PATENT DOCUMENTS

| | | | | | |
|---|---|---|---|---|---|
| 467,810 | A | | 1/1892 | Hughes | |
| 1,528,222 | A | | 3/1925 | Miller | |
| 2,502,681 | A | | 4/1950 | Swanson | |
| 2,718,312 | A | * | 9/1955 | Pilch | 37/410 |
| 3,362,548 | A | | 1/1968 | Cunningham | |
| 3,466,770 | A | * | 9/1969 | Morrison et al. | 37/410 |
| 3,909,963 | A | * | 10/1975 | Patel | 37/410 |
| 4,552,503 | A | | 11/1985 | Mouri et al. | |
| 4,848,011 | A | * | 7/1989 | Zimmerman | 374/10 |
| 4,848,483 | A | * | 7/1989 | Heiple | 172/821 |
| 4,889,362 | A | * | 12/1989 | Lagsdin | 280/763.1 |
| 4,925,358 | A | * | 5/1990 | Cook | 414/685 |
| 5,171,124 | A | | 12/1992 | Foster | |
| 5,209,307 | A | * | 5/1993 | Hotte | 172/445.2 |
| 5,562,398 | A | | 10/1996 | Knutson | |
| 5,822,892 | A | | 10/1998 | Ohbatake et al. | |

FOREIGN PATENT DOCUMENTS

EP 0409244 A2 * 1/1991 ..... 37/410

OTHER PUBLICATIONS

Brochure describing Ditch Witch Model 4010, Mar. 1987.*
Advertisement, R, H, & M Machine Co., "Go–For–Digger 4" with Backhoe Specifications for Digger 4 (2 pages).
Advertisement, R, H, & M Machine Co., "Go For Digger 5" with Backhoe Specifications for Digger 4 (2 pages).
Front and rear views of Go For Digger 4 Stabilizer (1 page).
Front and rear views of Go For Digger 5 Stabilizer (1 page).
Front view, Front Stabilizer, and Front Stabilizer Tipped of Go For Digger II (2 pages).
Front view, Front Stabilizer, and Front Stabilizer Tipped of Go For Digger 4 (2 pages).
Advertisement, R, H, & M Machine Co., "Go–For–Digger 6" with Backhoe Specifications for Digger 6 (2 pages).
Front view, Front Stabilizers, Front Stabilizers Tipped, Front Stabilizers Lifting on Uneven Surface, Front Stabilizers Cylinders, and Digger 5 Positioned for Digging, of Go For Digger 5 (3 pages).

* cited by examiner

*Primary Examiner*—Thomas B. Will
*Assistant Examiner*—Meredith Petravick
(74) *Attorney, Agent, or Firm*—Dorsey & Whitney LLP

(57) ABSTRACT

A multifunctional, self-contained towable backhoe apparatus adapted for direct over-the-road trailering by a towing vehicle, has a support frame having a front and a rear, and a trailering hitch attached to the front. Wheels support the frame at the front and the rear. The rear wheels can function as drive wheels. A backfill blade is movably attached to the rear of the frame. An articulated arm assembly is pivotably mounted on the rear of the frame. A stabilizer with a street pad, a spade, or both, can be secured to the front of the frame for stabilizing the apparatus while in a digging position. The movable backfill blade is capable of movement to a raised position for supporting the articulated arm during transport and movement to at least one lowered ground-engaging position capable of stabilizing the apparatus, of earth moving, or a combination thereof. One end of the articulated arm is adapted for attachment of a tool, including a digging bucket, a pavement breaker, an auger, a grapple, or a fork. The self-contained towable backhoe apparatus can also have a pad on the backfill blade capable of cushioning the articulated arm assembly.

24 Claims, 8 Drawing Sheets

TOWABLE EARTH DIGGING APPARATUS

FIELD OF THE INVENTION

The field of the invention relates to material or article handling involving an apparatus which includes a load carrier swingable in the vertical plane. More in particular, the invention relates to such an apparatus wherein the carrier is a scoop.

BACKGROUND OF THE INVENTION

Towable earth digging apparatuses are known. One such example is U.S. Pat. No. 4,925,358, ("the patent") to the inventors, Paul Cook and Karl Schulz, the entire disclosure of which is incorporated herein by reference. This device is a backhoe type of apparatus which is adapted for direct over-the-road trailering by an automobile-type vehicle. At one end of the device is an articulated swing with a scoop for excavating earth. The swing is attached to the frame of the apparatus on the back side, which is why the device is typically known as a backhoe. On the front of the device is a hitch for attaching it to a towing vehicle such as a truck or an automobile. When the device is not attached to a truck or car for movement, the device is deployed on an excavation site, which can be either a street or some non-friction surface. The device is moved around on four wheels until it is situated at a place where it can then be used to excavate. Then the apparatus is set up in a digging position. The device of the '358 patent is set up in the digging position by two outriggers on the back side, and one outrigger on the front, so the machine is set up on a tripod. The wheels that are used to maneuver the vehicle from one site to the next can be raised or be in contact with the ground, but in effect, the machine's weight is set up on the outriggers fore and aft to establish a stable three point digging platform. The problem with this device of the '358 patent is lack of versatility at the excavation site.

There is a need for such towable earth digging apparatuses to be able to plow and backfill holes, much like a bulldozer can move earth. The typical tractor loader backhoe, which is moved from one excavation site to another excavation site on a separate trailer, are large tractors having a loader bucket on the front of the device and a hoe or swing on the rear of the device. This is an excellent earth moving apparatus as both the ability to backfill or plow and the ability to excavate with the swing or boom, are provided in a single device. A towable, earth digging apparatus, such as is contemplated by the '358 patent, cannot easily accommodate the plow or backfill blade because on the front end the device must be towed with a hitch.

Furthermore, because of the compact nature of the towable earth digging apparatus such as is shown in the '358 patent, the addition of a backfill blade to the well-balanced three point structure must be done in such a way as to provide stability to the device for the swing or boom while being towed, as well as to the device when it is in a digging position.

Therefore, there is an unfilled need for a small maneuverable multi-functional apparatus that can be towed at highway speed behind a towing vehicle such as a light truck. The apparatus should be capable of excavating, back-filling, and other construction site tasks.

SUMMARY OF THE PRESENT INVENTION

The invention is a self-contained towable backhoe apparatus adapted for direct over-the-road towing by a truck and an automobile-type vehicle, and includes several features. One feature is a support frame having first and second ends and having a trailer hitch attached to the first end. Another feature is the wheels supporting the frame at the first end and the second end. Another feature includes a backfill blade movably attached to the second end of the frame. The apparatus also includes an articulated arm assembly, pivotably mounted on the second end of the frame. The articulated arm assembly can have many configurations, including a backhoe.

It is preferred that the apparatus have a stabilizer, sometimes known as an outrigger, secured to the first end of the frame for stabilizing the apparatus while in a digging position. This stabilizer can have a street pad for engaging the surface of the street, and to protect the street so it does not penetrate the tarmac. The stabilizer can also have a spade or a digging plate, for example, for penetrating a surface while the apparatus is in a digging position for surfaces such as earth and gravel, where the surface does not need such protection. This first end stabilizer can be both a combination of a street pad and a digging plate or spade. The movable backfill blade is capable of movement to a raised position for supporting the articulated arm during transport, and movement to at least one lowered ground engaging position capable of stabilizing the apparatus for digging, for earth moving, or any combination thereof.

There is at least one drive wheel for the device if a power drive is a required feature for a particular construction site or job. The articulated arm can also include standard types of tool attachments, for example, a scoop, digging bucket, auger, fork, scraper, breaker, cutting tool, or a grapple. The articulated arm can also include a brush for cleaning streets or walls.

The backfill blade is capable of being tilted from one side to the other to accommodate irregularities of surfaces, as well as manipulate the apparatus. The backfill blade is also capable of being raised and lowered.

Such an apparatus made in accordance with the description herein, is capable of being towed by a light truck and car, over the road at highway speeds because of its relatively light weight. The apparatus is adapted for direct trailering on its own wheels behind a towing vehicle, without need for an independent trailer, that is, equipment carrier, to carry the apparatus. Alternatively, the point of balance may be altered by extension of the boom and swing arm to unweight the tow hitch and enable an individual to lift the tow hitch off of the towing ball. Once at a particular site an individual can lift the hitch off of the towing ball of the towing vehicle by use of the first end stabilizer hydraulic cylinder to lift the first end of the apparatus. Once disconnected from the towing vehicle, the apparatus can be moved about from digging location to digging location on its four wheels. The device is capable of being driven, preferably by a hydraulic drive connected to least one wheel. Suitable engines, hydraulic drives and pumps are located on the device in such a manner as to move the device from digging site to digging site, and to excavate.

The location of motors, pumps, hydraulic reservoirs and the like, are important from the point of view of establishing a well balanced apparatus. The balance can be affected by the extension or retraction of the articulated arm. By extension of the articulated arm from the second end of the apparatus, the apparatus can be made to "crab-walk" and straddle or cross ditches.

The digging position is established by deploying the first end stabilizer and the second end backfill blade into contact with the surface. If on a street that needs protection, it is preferred that the surfaces of the supporting structure are protected with pads so as to prevent damage to the tarmac. If the surface is a non-friction surface such as gravel or dirt, the first end stabilizer and the second end backfill blade can actually penetrate the surface and provide anchoring forces against the digging forces of the articulated arm.

Therefore, it is an object of the invention to provide an apparatus which on the first end has a hitch to be towed by a truck and an automobile-type vehicle, and on the second end as both an excavating backhoe, which can also have other devices useful in and around a construction site attached to the end of the arm, as well as a backfill.

It is yet another object of the device to provide a two-point support for a towable backhoe wherein the digging platform is provided on the first end, with a centrally located stabilizer, and wherein the second end of the frame is supported in the digging position by a backfill blade, without the use of outriggers.

DETAILED DESCRIPTION OF THE INVENTION

Figure 1:
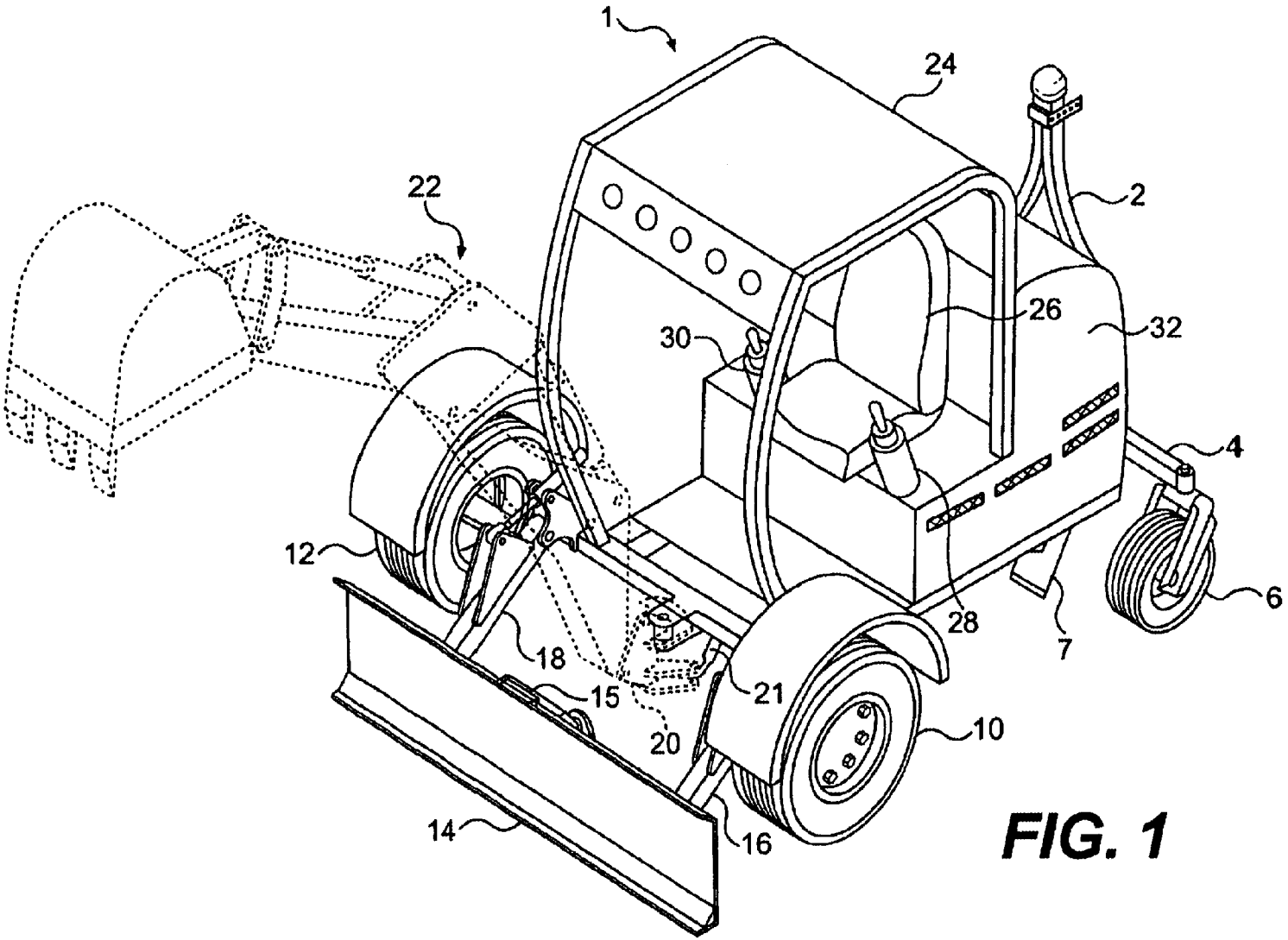
FIG. 1 is an elevated perspective showing the various features of the invention.

Referring to the drawings and particularly to FIG. 1, a towable mini-excavator according to the present invention 1, is shown in a digging position. FIG. 1 is an elevated perspective of the preferred embodiment of the invention. The front or first end of the machine is indicated by the location of the towing hitch 2, which is shown in FIG. 1 in the upward position showing the machine ready for movement around on site, with all four wheels 6, 8, 10, 12, on the ground. The front has wheels 6, 8, preferably caster wheels. The rear or second end of the machine is shown having rear wheels 10, 12. There is an articulated arm 22, attached to the rear of the frame with pivot pin and bracket weldment 20. The bracket weldment 20 can swing in response to cylinder 21, thereby pivoting the articulated arm 22 to the left or to the right.

There is also a backfill blade 14, attached to the rear of the machine by assemblies including tubular arms 16, 18. The backfill blade can optionally include a pad 15 capable of protecting the boom when the backfill blade is used to support the articulated arm. The protective pad 15 can be mounted on the top of the backfill blade. Additionally or alternatively a protective pad can be mounted on the bottom of the boom. A plurability of pads 15 can be used. The machine can have a seat 26 for an operator. Controls 28, 30, are easily and ergonomically accessible by the operator and permit full control of articulated arm 22 and tools, backfill blade 14, drive wheels 10, 12, and front stabilizer 7. Space is provided for hydraulic reservoirs, pumps, and engines and is optionally surrounded by a cowl 32 with optional contours and cooling slots. The weight of the engine and pumps serve to counterbalance the weight of the articulated assembly at the rear of the machine.

Figure 2:
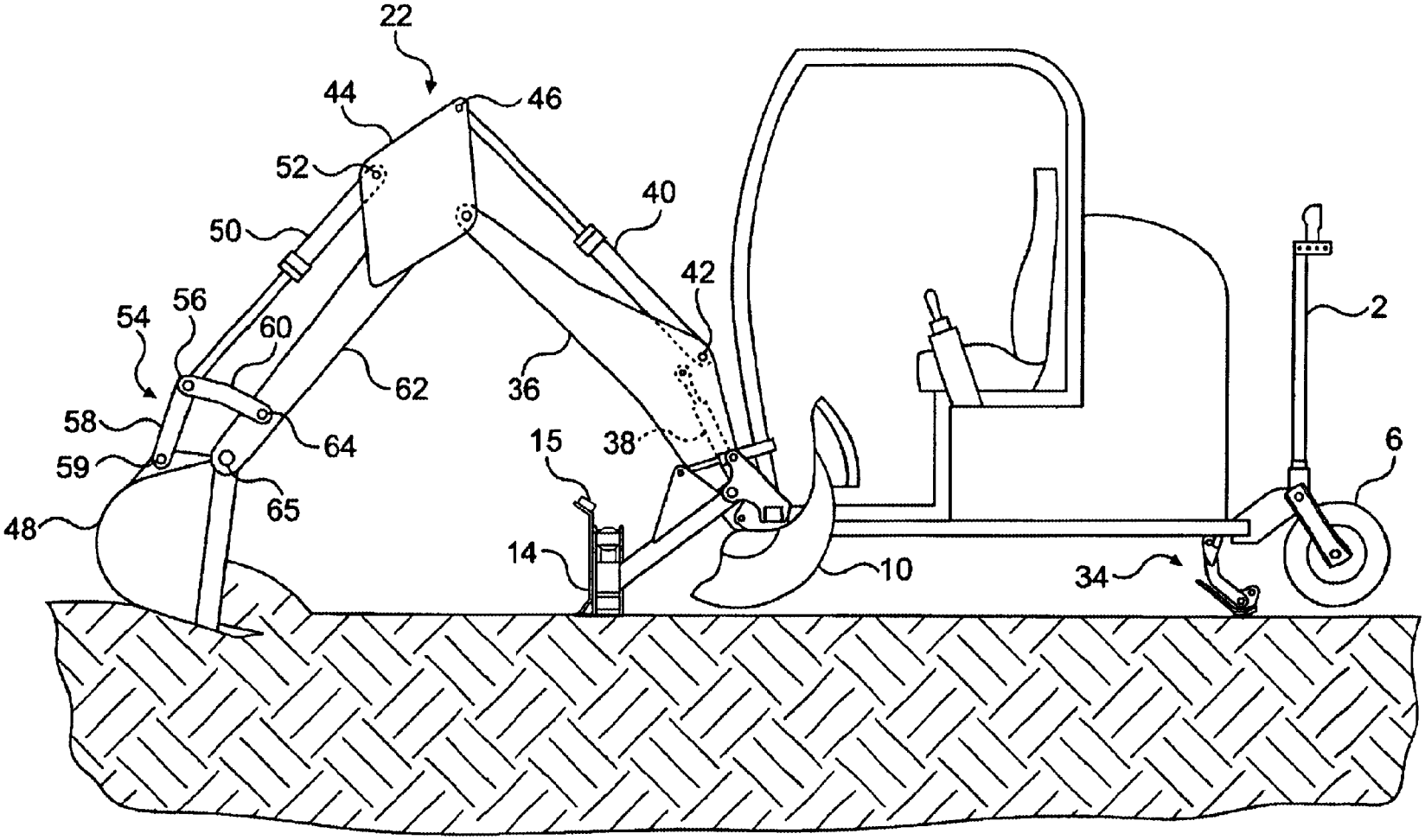
FIG. 2 is a side-plan view in schematic form showing the apparatus of the invention in a digging position such that the support structure is not penetrating the surface.

Referring to FIG. 2, the machine is shown in a digging position with hitch 2, in an upward position and wheel 6, elevated from the surface of the street. Moreover, front stabilizer 34 is deployed to engage the surface of the street, and stabilize the position of the machine. Rear stabilizer 14 is also engaged to contact the street and stabilize the position of the apparatus, thereby elevating rear wheel 10 from the street surface. The articulated arm assembly 22 is shown deployed in a digging position. Articulated arm assemblies, such as hoes, are known and are available as standard assemblies or by custom manufacture. In one embodiment, extension and retraction of the boom 36 is controlled by hydraulic cylinder 38. The articulated arm assembly 22 is extended and retracted by hydraulic cylinder 40 attached to the boom 36 at pivot 42 and to a double plate 44 at pivot 46. Position of the digging bucket 48 is controlled by hydraulic cylinder 50 attached to the double plate 44 at pivot 52 and to the control linkage 54 at pivot 56. A pivot bracket 58 connects the hydraulic cylinder 50 at pivot 56 to the back of the digging bucket 48. A bracket linkage 60 connects the hydraulic cylinder 50 and pivot bracket 58 at pivot 56 to the farther end of a dipper 62 at pivot 64. The digging bucket 48 is attached to pivot bracket 58 at pivot 59 and to dipper 62 at pivot 65. A digging bucket 48, as shown in FIG. 2, is the preferred embodiment of the invention, but optionally other tools may be used at the end of the articulated arm assembly 22. The articulated arm can include a Quick-Attach at pivots 59 and 65 for rapid exchange of tools. The other tools can include a hammer or pavement breaker for use to break concrete or road surface, or a pile driver. Another standard tool for use with the articulated arm assembly is an auger, suitable for digging fence post or telephone pole holes. In addition, a grapple for moving pipe or poles is suitable for use as a tool of the invention. Other tools suitable for use with the invention are a fork, a cutting tool, a brush, and a scraper. All such tools are standard in the art.

Figure 3:
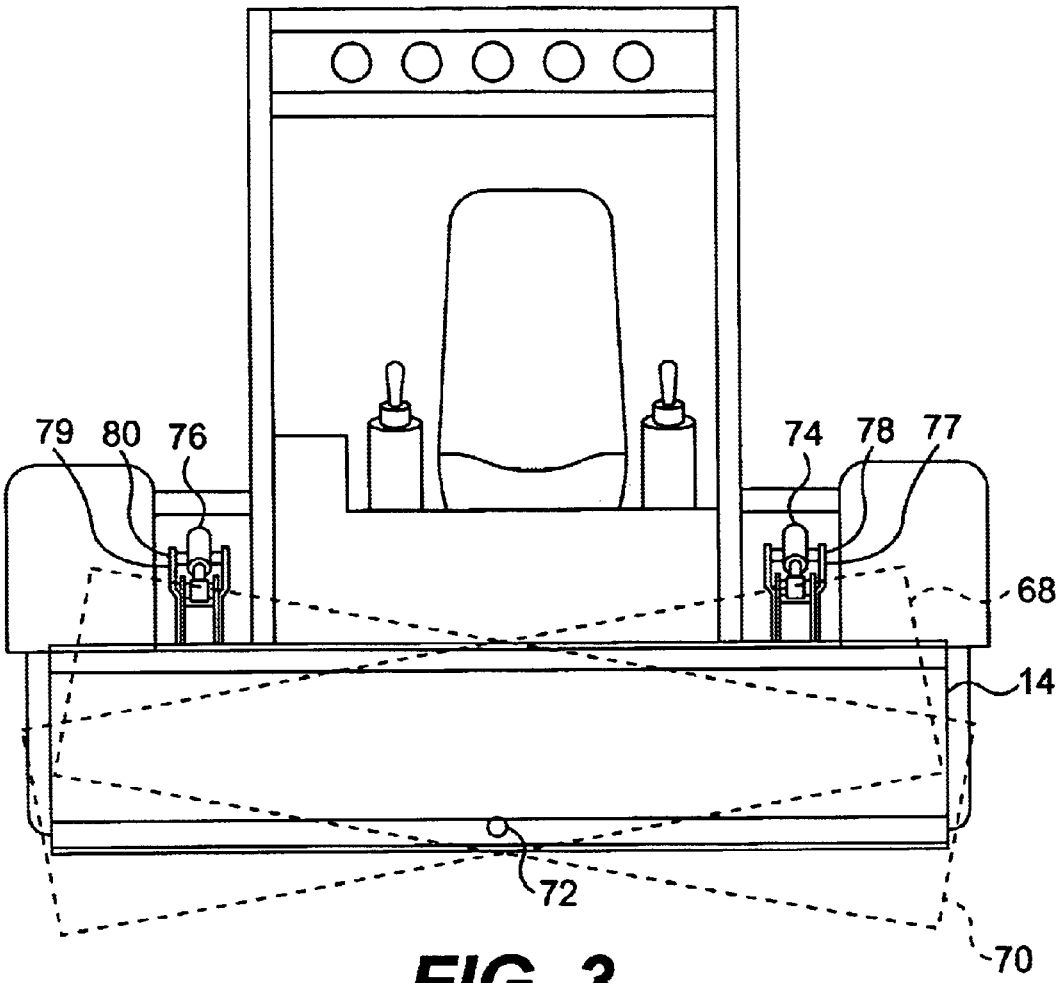
FIG. 3 is a rear-plan view of the invention showing the backfill blade feature.

Referring to FIG. 3, the backfill blade 14 is shown in optional positions 68, 70. The backfill blade 14 is tiltable around pivot 72 to adjust to the angle of the surface of the ground or street. Backfill blade 14 is raised or lowered by hydraulic cylinders 74, 76 attached to U-shaped ear bracket 77, 79 at pivots 78, 80. The backfill blade can be lowered to engage the ground for moving earth or for providing stabilization for the rear of the machine. Similarly, the backfill blade can be adjusted to a plurality of intermediate positions to engage the ground or street at any of a number of positions and angles. The backfill blade can be tilted, raised and lowered to function in many positions.

Figure 4:
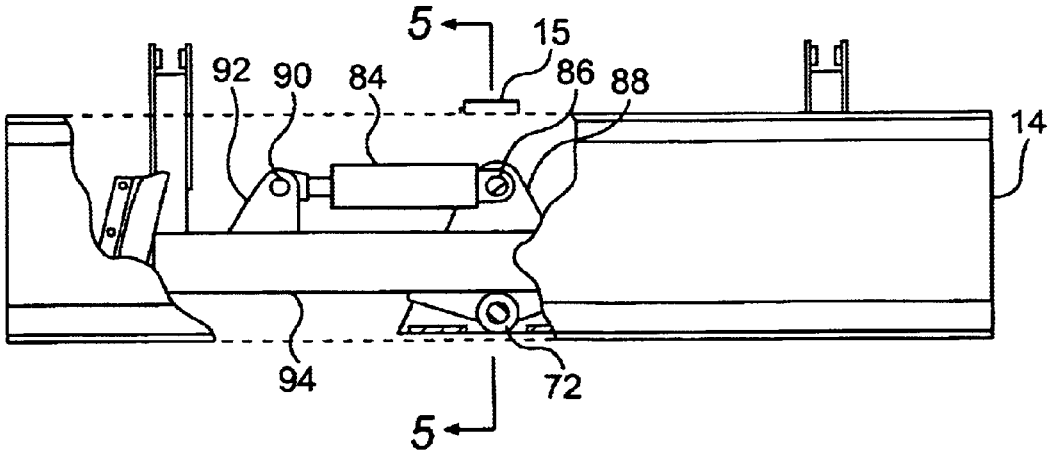
FIG. 4 is a rear-plan view in cut-away showing the detail of the articulating structure for the backfill blade.

Referring to FIG. 4, the backfill blade 14 is shown in cut-away section to illustrate the mechanism for tilting the blade. Hydraulic cylinder 84 is attached at pivot 86 to blade tilt weldment 88 to change the angle of the backfill blade 14 by pivoting around pivot 72. The other end of the hydraulic cylinder 84 is attached at pivot 90 to connecting weldment 92, which is connected to horizontal member 94 and thereby to the lifting apparatus including arm 16 and 18.

Figure 5:
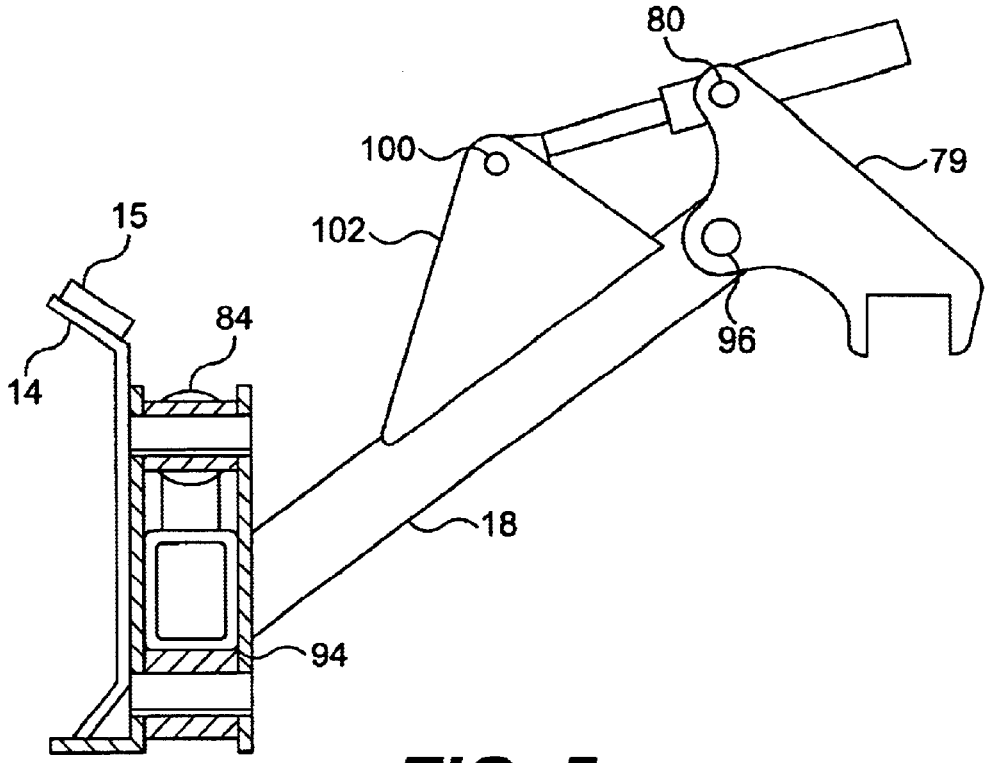
FIG. 5 is a side-plan view showing details of the structure of the backfill blade.

Referring to FIG. 5, a cut-away section side view of the backfill blade, is depicted. The fill earth engaging portion of the backfill blade 14 can tilt in relation to the horizontal member 94. The backfill blade can be raised or lowered by moving arm element 18 and its pair 16 about pivot point 96 and its pair 78. The backfill blade is raised or lowered by the effect of hydraulic cylinders 76, 74 pivoting on pivots 78, 80. The double weldment 102 is welded to arm 18 such that cylinder 76 causes the back fill blade 14 to pivot on pivots 96, 97. U-shaped ear bracket 79 with pivot points 80 and 96 is attached to the frame. Components corresponding to elements 18, 76, 80, 96, 98,100, and 102 are appropriately placed to control the other side of backfill blade 14.

Figure 6:
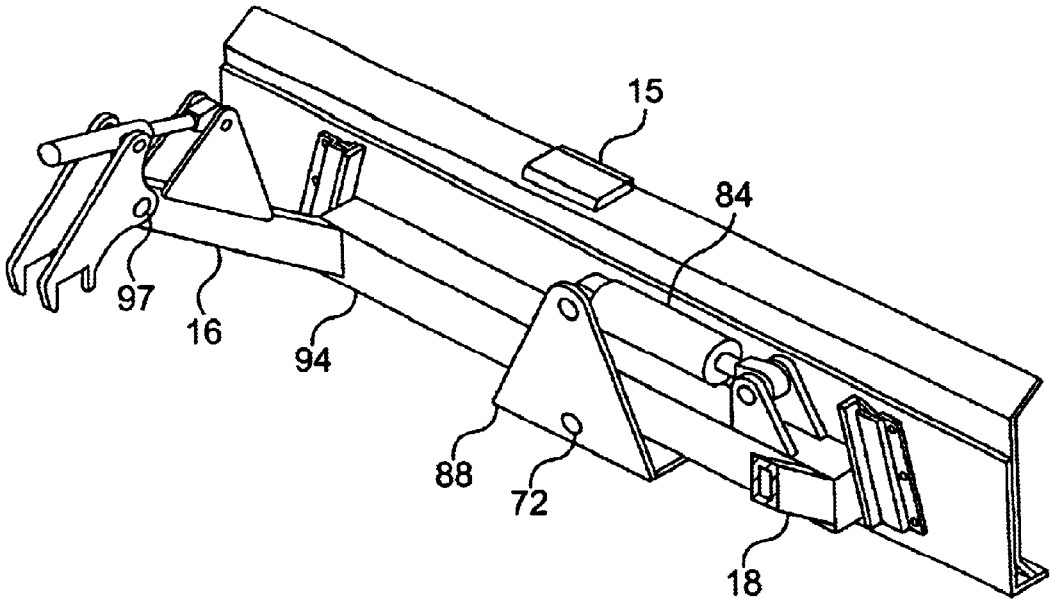
FIG. 6 is an elevated perspective of the structure of FIG. 4.

FIG. 6 is an elevated rear view of the tilt mechanism and the mechanism to raise and lower the backfill blade.

Figure 7:
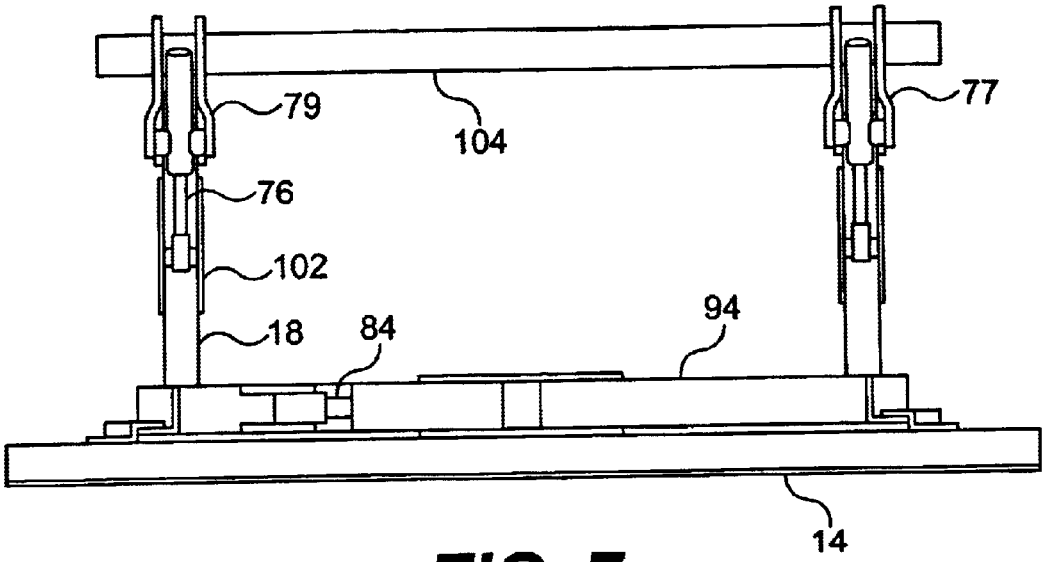
FIG. 7 is a top-plan view of the backfill blade showing its articulating structure attached to the frame of the invention.

FIG. 7 is a top view of the backfill blade showing both the tilt mechanism, including hydraulic cylinder 84 and the vertical positioning mechanism, including tubular support 18, double weldment 102, hydraulic cylinder 76, and U-shaped ear bracket 79, affixed to frame 104. Ear bracket 79 can optionally be a double bracket weldment.

Figure 8:
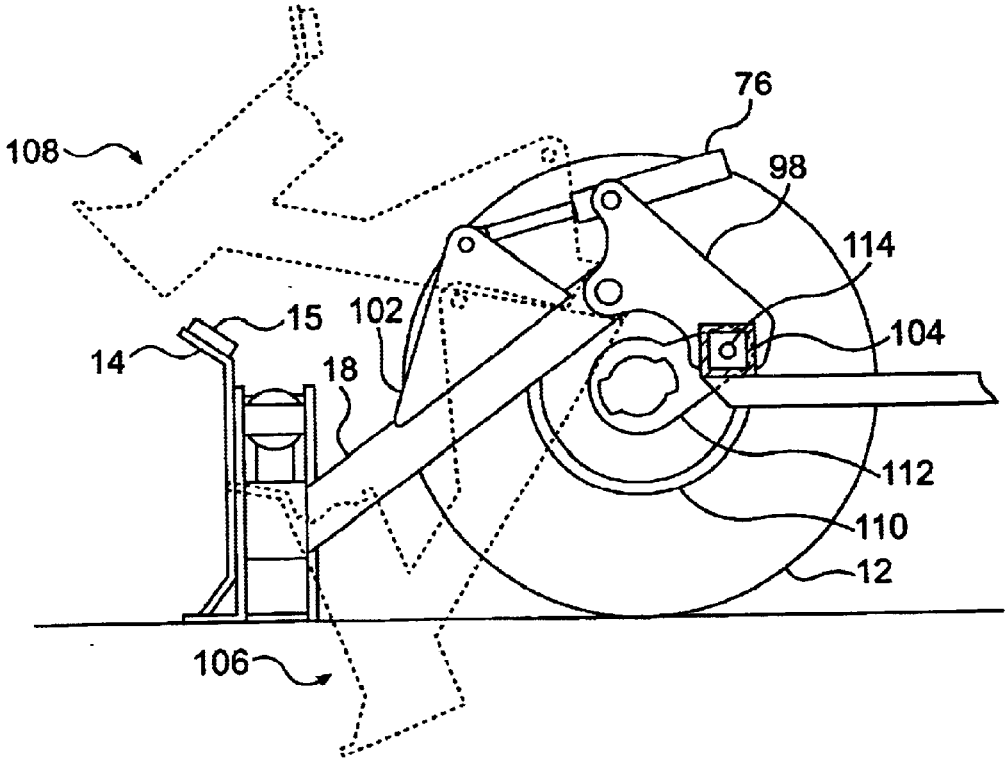
FIG. 8 is a side-plan view of the articulating structure for the backfill blade in relation to the wheel offset and frame.

Referring particularly to FIG. 8, the backfill blade is shown in the at-grade position, and in the ground engaging below-grade position 106, and in the elevated boom supporting position 108. In each position the backfill blade may also be tilted. In the elevated position 108, the pad 15 contacts boom 36 to provide support and distribute weight of the boom onto the backfill blade without damaging the boom. The drawing also shows the drive wheel 110 on which is mounted the tire 12. The drive wheel suspension arm 112 is capable of swinging through about a 45° arc around pivot 114 on the frame member 104. Each wheel may be independently power driven by, for example, a hydraulic drive. A number of drive systems are adaptable to the invention and are well known in the art. The power to the wheels is controlled by the operator. Moreover, the wheels may be disengaged at the hub for highway speed transport by over-the-road towing.

Figure 9:
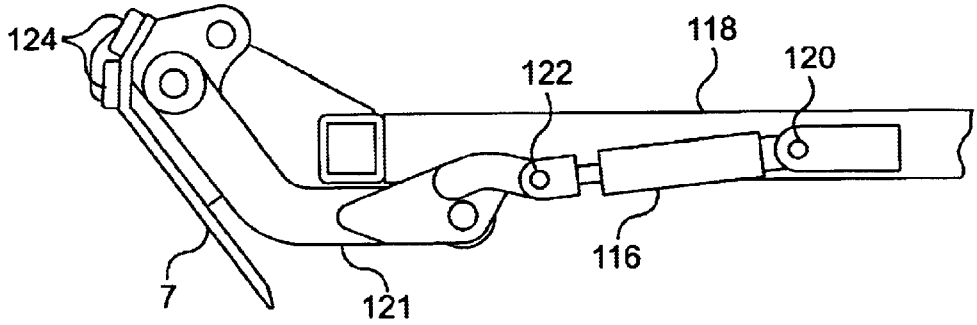
FIG. 9 is a side plan view of the articulating structure for the front outrigger.
Figure 10:
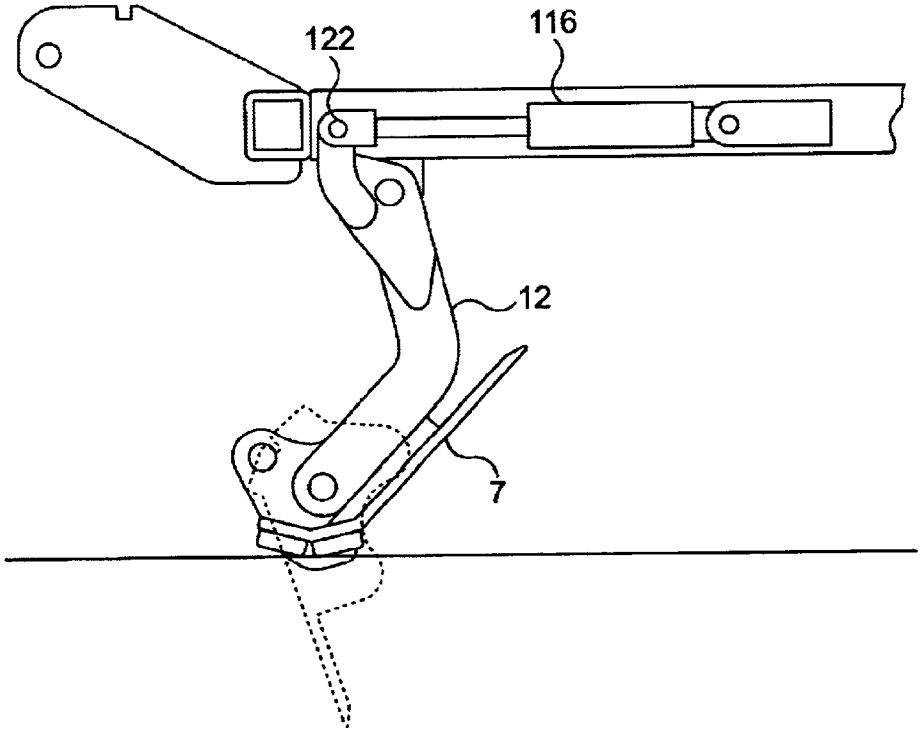
FIG. 10 is a side-plan view of the articulating structure of FIG. 9 and how it can be deployed.

Referring to FIG. 9, a side view of the first end stabilizer 34 is shown in the rest position. Hydraulic cylinder 116 is attached to frame member 118 at pivot point 120. The cylinder is also attached to the first end stabilizer which includes pivot arm 121, movably attached to the cylinder at pivot point 122. The pivot arm 121 permits the deployment of the ground engaging spade 7 for use on non-friction surfaces such as gravel or dirt. The pivot arm 121 also permits deployment of at least one pad(s) 124 for engagement of the tarmac. In a preferred embodiment, the first end stabilizer has three pads or a curved pad. The deployment of the first end stabilizer is shown particularly in FIG. 10, with the stabilizer in contact with a pavement or tarmac surface or alternatively in a gravel or soil surface.

Figure 11:
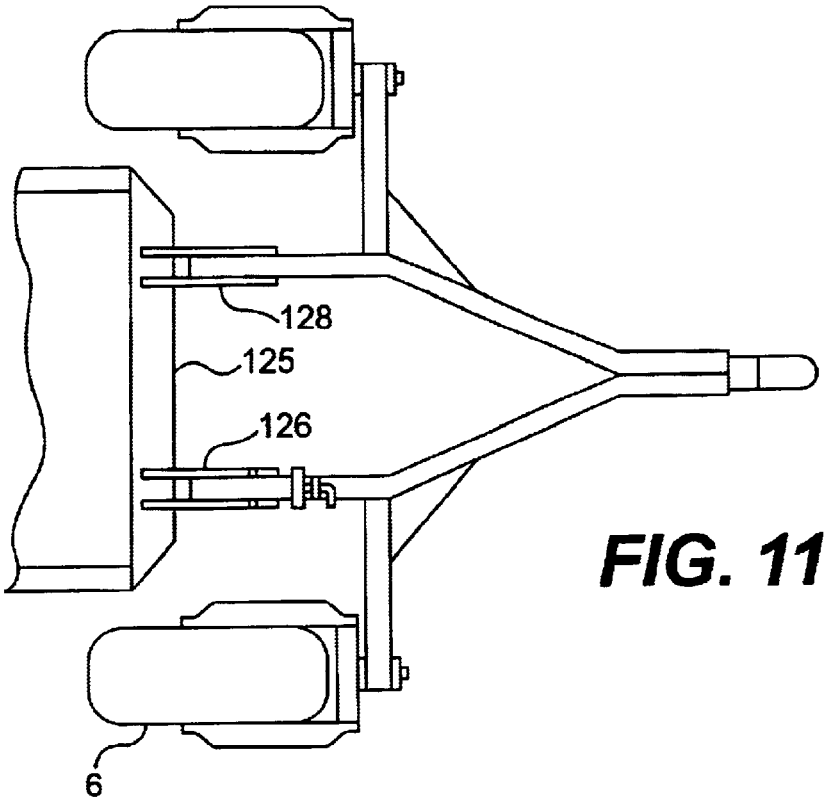
FIG. 11 is a top-plan view of the front end of the invention showing the towing hitch in relation to the front wheels and the articulating structural attachment to the front of the frame.
Figure 12:
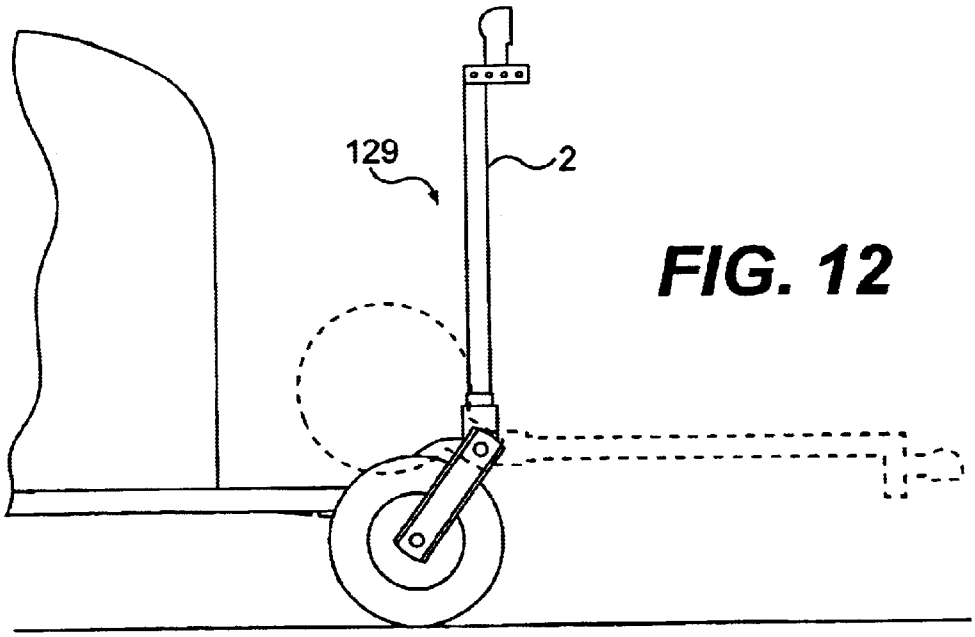
FIG. 12 is a side-plan view of FIG. 11 showing articulation of the tow hitch and front wheels in the towing position and in the driving position.

The towing hitch is illustrated in FIG. 11, which shows the caster wheels 6, 8 in a position deployed as a trailer to a towing vehicle. The hitch is attached to the frame 125 by hitch ear weldments 126, 128. As illustrated in FIG. 12, the hitch may be used either in the deployed position for towing, or alternatively in the non-deployed position 129 for movement of the apparatus at the job site.

Figure 13:
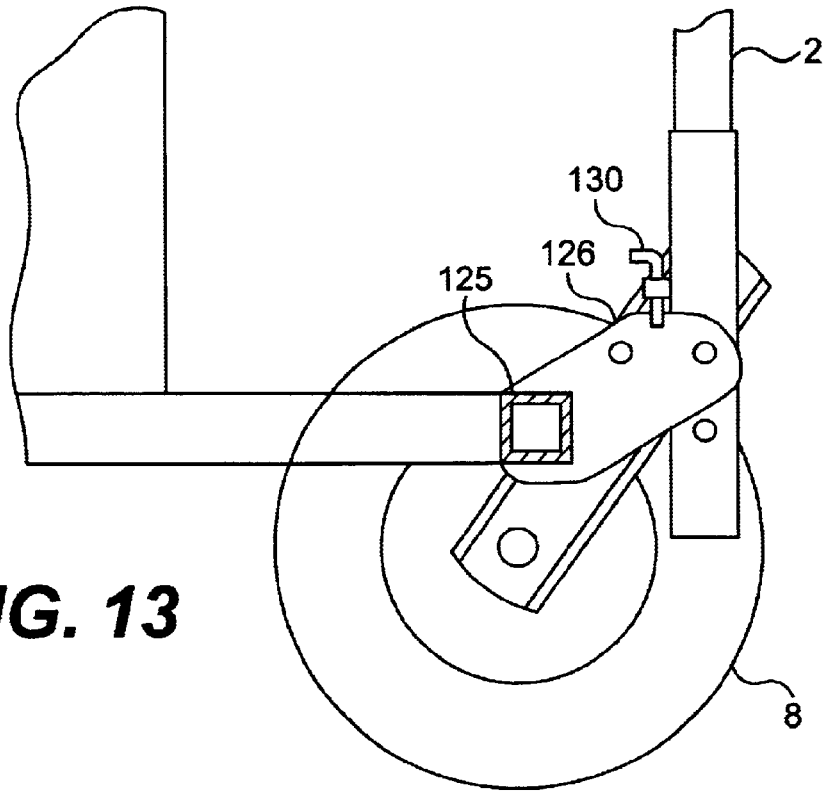
FIG. 13 is a side-plan view showing detail of FIG. 12 in the driving position.
Figure 14:
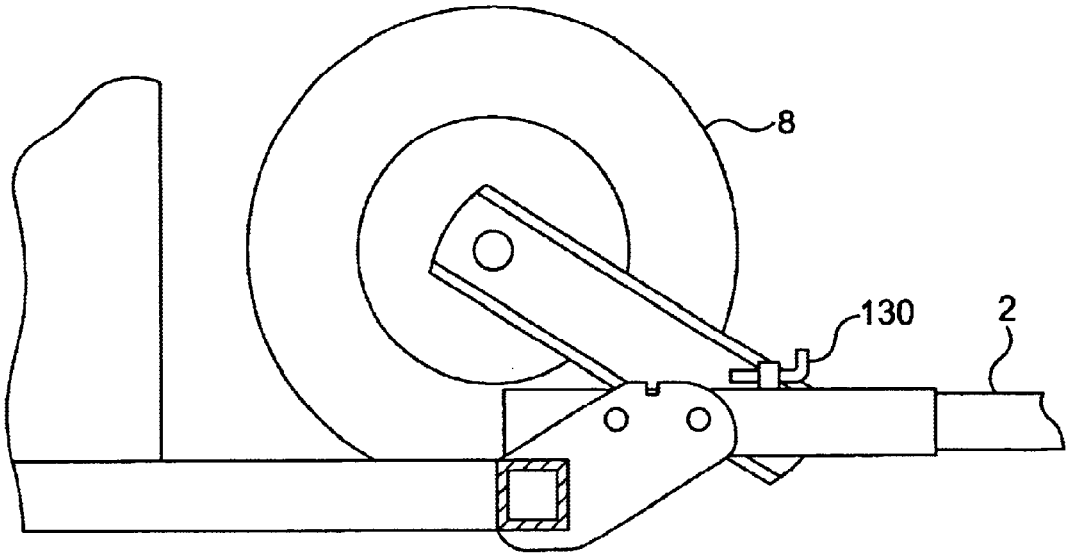
FIG. 14 is a side-plan view showing detail of FIG. 12 in the towing position.

The non-deployed position is further illustrated in FIG. 13, in which the hitch arm 2 is in the elevated position. This causes the wheel 8 to be in the ground contact position for movement of the apparatus at the job site. A locking device 130 secures the hitch into hitch ear weldment 126 attached to the frame 124. In the hitch deployed position, as shown in FIG. 14, the caster wheels are not in contact with the ground or tarmac and the locking device 130 permits the hitch to keep the wheels suspended.

The apparatus is capable of several modes of movement. Among these are a crab-walk, in which the articulated arm assembly is used to lift wheels from the surface and to change the balance point of the apparatus. The crab-walk mode is useful for moving across ditches and gulleys and for sideways movement. Another mode of movement involves positioning the articulated arm assembly to counterbalance the weight of the excavator. Another mode of movement is powered movement using the second end drive wheels controlled by the operator. Another mode of movement is to adjust the point of balance such that an individual may move the invention from the tow hitch end much like a wheel barrel. In a preferred embodiment the apparatus weighs about 3,000 pounds and has a tongue weight of about 300 pounds.

The drive wheels are operated independently to permit turning and easy maneuverability. In addition, the apparatus can be towed by a towing vehicle. The towing vehicle should have towing capacity sufficient to pull the apparatus and a towing ball capable of bearing the appropriate tongue weight. In general, a truck or automobile-type vehicle is suitable as a towing vehicle. More particularly a dump truck or a light truck equipped for towing is suitable.

The location of the backhoe and backfill blade on the same end of the apparatus makes the apparatus very versatile. For example, without changing positions the operator can alternately excavate or trench and backfill any holes that are open. Similarly, pavement can be broken up with the pavement breaker or the digging bucket and the debris collected using the backfill blade. In addition, the operator can use the backhoe and backfill blade together to wedge boulders between the backfill blade and the backhoe, and thereby lift the boulder(s) even if the boulder(s) are larger than would normally be possible to lift with the digging bucket alone. The apparatus can prepare substantially vertical holes with an auger attachment to the articulated arm assembly. In addition, with a grapple attachment to the articulated arm assembly, the apparatus is suitable for moving pipe or poles around the construction site.

The power for the apparatus is supplied by any of a variety of small internal combustion engines mounted under the cowl 32 and connected to one or more standard or high precision hydraulic pumps. Examples of appropriate engines include those fueled by gasoline, diesel fuel or compressed natural gas. The standard or high precision hydraulic pump provides hydraulic liquid to circulate from a reservoir to several hydraulic cylinder units under control of the operator using controls 28, 30. One skilled in the art will understand that additional controls can be used so the operator has complete control of the first end stabilizer, second end stabilizer, engine, drive wheels, articulated arm assembly, tools, hydraulic pumps, lamps, and other normal apparatus functions. The term hydraulic cylinders includes double acting hydraulic cylinders, single acting hydraulic cylinders, and pairs of counteracting hydraulic cylinders. The use of a high efficiency pump permits construction of a small, compact and lightweight unit while providing the high pressure necessary for operating the articulated arm assembly, backfill blade, first end stabilizer, the drive wheels, and other components.

The apparatus can also power other tools at the construction site. These tools include a saw used, for example, to make a neat cut in pavement. Similarly the tool can include a water pump used, for example, to remove mud and water from a water main leak.

The purpose of the above description is to illustrate some embodiments of the present invention, without implying any limitation. It will be apparent to those of skill in the art, in light of this teaching, that various modifications and variations may be made to components and methods in the present invention to generate additional embodiments, without departing from the spirit or scope of the invention. The specific composition of the various elements of the excavator system, for example, should not be construed as a limiting factor. Accordingly, it is to be understood that the drawings and descriptions in this disclosure are proffered to facilitate comprehension of the invention, and should not be construed to limit the scope of the invention as defined in the claims.

We claim:

1. A self-contained towable backhoe apparatus adapted for direct over-the road trailering by a towing vehicle, comprising:

(a) a support frame having a first end and a second end, and having a trailer hitch attached to said first end;

(b) wheels supporting the frame at said first end and said second end;

(c) a backfill blade movably attached to the second end of said frame;

(d) an articulated arm assembly, pivotably mounted on the second end of said frame, containing a digging tool; and (e) at least one stabilizer secured to the first end of the frame, whereby a digging position is established for using the digging tool by deploying the first end stabilizer and the second end backfill blade in contact with the surface.

2. The apparatus of claim 1 wherein said first end stabilizer has a street pad for engaging the surface of a street while the apparatus is in the digging position, to protect the street surface.

3. The apparatus of claim 2 wherein said first end stabilizer includes three street pads.

4. The apparatus of claim 1 wherein said first end stabilizer has a spade for penetrating a surface while the apparatus is in the digging position, to prevent movement generated by digging forces.

5. The apparatus of claim 1 wherein said first end stabilizer has a combination of a street pad and a spade.

6. The apparatus of claim 1 wherein said movable backfill blade is capable of movement to a raised position for supporting the articulated arm during transport and movement to at least one lowered ground-engaging position capable of stabilizing said apparatus, of earth moving, or a combination thereof.

7. The apparatus of claim 1 wherein at least one wheel is a drive wheel.

8. The apparatus of claim 1 wherein the digging tool is a digging bucket, a pavement breaker, an auger, a grapple, or a fork.

9. The apparatus of claim 1 wherein said backfill blade is capable of being raised and lowered, and tilted from one side to the other.

10. The apparatus of claim 1, further including a tilt mechanism for automatically tilting the backfill blade.

11. The apparatus of claim 1 wherein the backfill blade is capable of contacting the ground at varying angles in order to level the apparatus.

12. The apparatus of claim 1 wherein said first end stabilizer includes a pivot point for pivoting of the articulating arm assembly.

13. A self-contained towable backhoe apparatus adapted for direct over-the road trailering by a towing vehicle, comprising:

(a) a support frame having a first end and a second end, and having a trailer hitch attached to said first end;

(b) wheels for supporting the frame at said first end and said second end;

(c) an articulated arm assembly, pivotably mounted on the second end of said frame, for manipulating an attached digging tools;

(d) a backfill blade movably attached to the second end of said frame, wherein said blade is capable of movement to a raised position for supporting the articulated arm during transport and movement to a lowered ground-engaging stabilizing position; and (e) at least one stabilizer secured to first end of said frame, whereby a digging position is established for using the digging tool by deploying the first end stabilizer and the second end backfill blade in contact with the surface.

14. The apparatus of claim 13 wherein the digging tool is a digging bucket, a hammer, an auger, a grapple, or a fork.

15. The apparatus of claim 13 wherein said first end stabilizer has a street pad for engaging the surface of a street while the apparatus is in the digging position, to protect the street surface.

16. The apparatus of claim 13 wherein said first end stabilizer has a spade for penetrating a surface while the apparatus is in the digging position, to prevent movement generated by digging forces.

17. The apparatus of claim 13 wherein said first end stabilizer has a combination of a street pad and a spade.

18. The apparatus of claim 13 wherein said first end stabilizer has a combination of a street pad and a spade.

19. A self-contained towable apparatus adapted for direct over-the-road trailering by a towing vehicle, comprising:

(a) a support frame having a first end and a second end, having wheels movably attached thereto and a towing hitch attached to said first end;

(b) an articulated arm assembly pivotably mounted on the second end of said frame, with a digging tool attachment selected from a bucket, a hammer, an auger, a grapple, or a fork;

(c) a backfill blade attached to the second end of said frame, wherein said backfill blade is capable of being raised and lowered, and tilted from one side to the other; and (d) at least one front stabilizer secured to first end of said frame, whereby a digging position is established for using the digging tool attachment by deploying the first end stabilizer and the second end backfill blade in contact with the surface.

20. The apparatus of claim 19 wherein said first end stabilizer has a street pad for engaging the surface of a street while the apparatus is in the digging position, to protect the street surface.

21. The apparatus of claim 19 wherein said first end stabilizer has a spade for penetrating a surface while the apparatus is in the digging position, to prevent movement generated by digging forces.

22. The apparatus of claim 19 wherein said first end stabilizer has a combination of a street pad and a spade.

23. A self-contained towable backhoe apparatus adapted for direct over-the-road trailering by a towing vehicle, comprising:

(a) a support frame having a first end and a second end;

(b) an articulated arm assembly, pivotably mounted on the second end of said frame, containing a digging bucket;

(c) a backfill blade movably attached to the second end of said frame, wherein said backfill blade comprises a pad capable of cushioning said articulated arm assembly;

(d) at least one stabilizer secured to the first end of the frame; and (e) wheels supporting the frame at said first end and said second end, whereby a digging position is established for using the digging bucket by deploying the first end stabilizer and the second end backfill blade in contact with the surface.

24. The apparatus of claim 23 which further comprises a trailering hitch attached to said first end.

* * * * *